US008590946B2

(12) United States Patent
Cumbo et al.

(10) Patent No.: US 8,590,946 B2
(45) Date of Patent: Nov. 26, 2013

(54) DECKLID LATCH WITH ELECTROMECHANICALLY ACTUATED SNOWLOAD LEVER

(75) Inventors: Francesco Cumbo, Pisa (IT); Luca Bigazzi, Ponsacco (IT)

(73) Assignee: Magna Closures Inc., Newmarket (CA)

( * ) Notice: Subject to any disclaimer, the term of this patent is extended or adjusted under 35 U.S.C. 154(b) by 538 days.

(21) Appl. No.: 12/601,919

(22) PCT Filed: May 26, 2008

(86) PCT No.: PCT/CA2008/001002

§ 371 (c)(1), (2), (4) Date: Nov. 25, 2009

(87) PCT Pub. No.: WO2008/144904

PCT Pub. Date: Dec. 4, 2008

(65) Prior Publication Data

US 2010/0171320 A1 Jul. 8, 2010

Related U.S. Application Data

(60) Provisional application No. 60/940,083, filed on May 25, 2007.

(51) Int. Cl.
*E05C 3/06* (2006.01)
*E05C 3/16* (2006.01)

(52) U.S. Cl.
USPC ..... 292/201; 292/216; 292/DIG. 23

(58) Field of Classification Search
USPC ..... 292/201, 216, DIG. 23, 200, DIG. 14, 292/DIG. 29
See application file for complete search history.

(56) References Cited

U.S. PATENT DOCUMENTS 4,624,491 A * 11/1986 Vincent ..... 292/201
4,824,152 A * 4/1989 Jeavons ..... 292/216

(Continued)

FOREIGN PATENT DOCUMENTS

DE 10105445 4/2002
DE 10344244 4/2004

(Continued)

OTHER PUBLICATIONS

Computer-generated translation for DE 10105445 A1 using the EPO's website; http://gb.espacenet.com/search97cgi/s97_cgi.exe?Action=FormGen&Template=gb/EN/home.hts.*

(Continued)

*Primary Examiner* — Carlos Lugo
*Assistant Examiner* — Alyson M Merlino
(74) *Attorney, Agent, or Firm* — Miller Canfield

(57) ABSTRACT

A latch including a ratchet moveable between a latched position and a released position, with the ratchet being biased to the released position. A pawl being moveable between a ratchet-engaged position in which the pawl checks the movement of the ratchet and a ratchet-disengaged position, with the pawl being biased to the ratchet-engaged position. An electromechanical actuator having an output member for moving the pawl to the ratchet-disengaged position with the actuator output member moving between a start position and an end position and vice versa. A snowload lever being moveable between a pawl-disengaged position and a pawl-engaged position, wherein, in the pawl-engaged position, the snowload lever blocks the actuator output member from returning to the start position.

11 Claims, 4 Drawing Sheets

(56) References Cited

U.S. PATENT DOCUMENTS

| | | | | |
|---|---|---|---|---|
| 4,969,672 | A * | 11/1990 | Childs et al. | 292/201 |
| 4,974,886 | A * | 12/1990 | Kleefeldt et al. | 292/201 |
| 4,978,154 | A * | 12/1990 | Kleefeldt et al. | 292/201 |
| 4,986,098 | A * | 1/1991 | Fisher | 70/262 |
| 5,078,436 | A * | 1/1992 | Kleefeldt et al. | 292/201 |
| 5,137,311 | A | 8/1992 | Brackmann | |
| 5,419,597 | A * | 5/1995 | Brackmann et al. | 292/201 |
| 5,642,636 | A * | 7/1997 | Mitsui | 70/237 |
| 5,722,272 | A * | 3/1998 | Bridgeman et al. | 70/264 |
| 5,934,717 | A | 8/1999 | Wirths | |
| 6,079,237 | A * | 6/2000 | Hochart | 70/278.6 |
| 6,364,679 | B1 * | 4/2002 | Gerstberger | 439/241 |
| 6,557,910 | B2 | 5/2003 | Amano | |
| 6,565,132 | B2 * | 5/2003 | Mork et al. | 292/216 |
| 6,698,805 | B2 | 3/2004 | Erices et al. | |
| 6,773,042 | B2 * | 8/2004 | Spurr et al. | 292/216 |
| 6,866,311 | B2 * | 3/2005 | Spurr et al. | 292/216 |
| 6,997,488 | B2 * | 2/2006 | Kurten et al. | 292/201 |
| 7,111,877 | B2 | 9/2006 | Larsen et al. | |
| 7,159,907 | B2 * | 1/2007 | Song | 292/216 |
| 7,175,210 | B2 * | 2/2007 | Orzech et al. | 292/216 |
| 7,261,339 | B2 | 8/2007 | Kiehl | |
| 7,467,815 | B2 * | 12/2008 | Larsen et al. | 292/201 |
| 7,475,920 | B2 * | 1/2009 | Bigazzi et al. | 292/201 |
| 7,963,576 | B2 * | 6/2011 | Bigazzi et al. | 292/201 |
| 2002/0167175 | A1 | 11/2002 | Weyerstall et al. | |
| 2003/0038484 | A1 * | 2/2003 | Schwaiger et al. | 292/201 |
| 2003/0038485 | A1 * | 2/2003 | Schwaiger et al. | 292/201 |
| 2004/0232707 | A1 | 11/2004 | Kachouh | |
| 2005/0082842 | A1 * | 4/2005 | Warmke et al. | 292/216 |
| 2005/0167990 | A1 | 8/2005 | Orzech et al. | |
| 2007/0007774 | A1 | 1/2007 | Stefanic | |
| 2008/0224482 | A1 * | 9/2008 | Cumbo et al. | 292/216 |

FOREIGN PATENT DOCUMENTS

| | | | |
|---|---|---|---|
| DE | 102006032033 | | 3/2007 |
| EP | 1321612 | A2 | 6/2003 |
| JP | 2006009559 | A * | 1/2006 |
| WO | 03054332 | A1 | 7/2003 |

OTHER PUBLICATIONS

European Search Report.

* cited by examiner

DECKLID LATCH WITH ELECTROMECHANICALLY ACTUATED SNOWLOAD LEVER

CROSS-REFERENCE TO RELATED APPLICATIONS

This application is a national phase application and claims priority to and all the benefits of, under 35 USC 371, of PCT/CA2008/01002, filed on May 26, 2008, which in turn claims the priority of U.S. Provisional Application No. 60/940,083, filed on May 25, 2007 and entitled "Decklid Latch with Electromechanical Actuated Snowload Lever". All applications are incorporated herein by reference in their entireties.

FIELD OF INVENTION

The invention relates to the art of latches.

BACKGROUND OF INVENTION

An external load on a latch, for example, caused by the weight of snow on a decklid, can sometimes prevent the ratchet from moving to the open position. In this situation, it is possible for the pawl to move to the open position, which can subsequently result in a failure of the latching operation, as the ratchet and pawl do not move in unison.

In order to avoid such problems, it is known to incorporate a "snow load" lever in the latch, which keeps the pawl in the released position until such time as the ratchet completes its opening movement. In the typical solution, the snowload lever acts directly on the pawl. However, this is problematic in that the mechanism may be activated when the decklid is slammed, whereby the pawl is kept in the open position whilst the ratchet rebounds.

One solution that avoids some of the problems of a directly coupled snowload lever is the use of a two-part pawl construction. Examples of such solutions are found in WO 03/054332 published 3 Jul. 2003 and in DE 3406116 published 22 Aug. 1985. However, the two-part pawl construction increases the number of components required.

A different solution is desired.

DETAILED DESCRIPTION OF PREFERRED EMBODIMENTS

Figure 1:
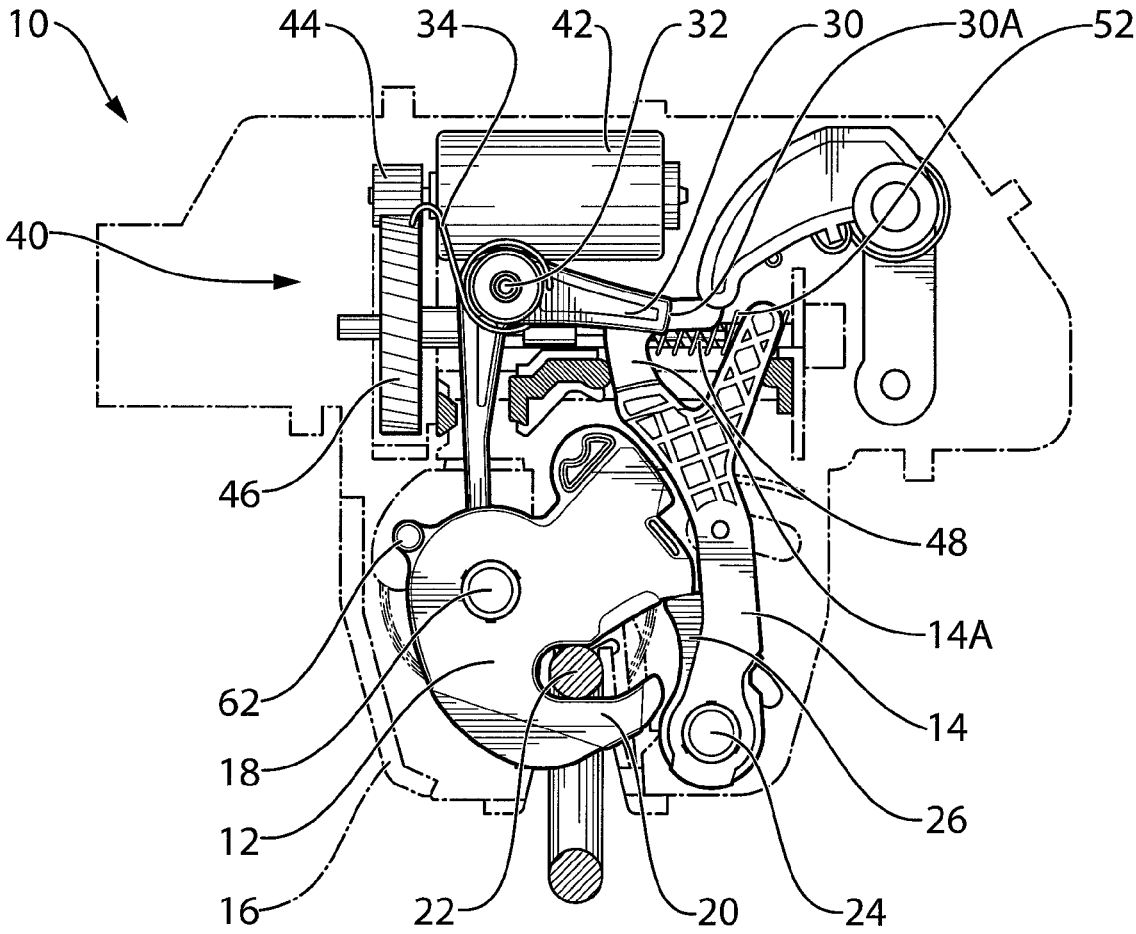
FIG. 1 is a plan view of a latch according to one aspect of the invention in a latched position.

Referring to FIG. 1, latch 10 includes a ratchet 12 and pawl 14. The ratchet 12 is pivotally mounted to a support body 16 via pin 18. The ratchet 12 rotates between a "latched" position in which hook 20 captures a striker 22 and a "released" position in which the hook 20 is orientated to release the striker 22 (see FIG. 6). The ratchet 12 is biased to the "released" position (biasing springs not shown). The pawl 14 is pivotally mounted to the support body 16 via pin 24. The pawl 14 rotates between an "engaged" position in which a pawl shoulder 26 checks the rotation of the ratchet 12 and a "disengaged" position where the pawl shoulder 26 is withdrawn from the rotational path of the ratchet 12, enabling the ratchet 12 to rotate into its released position. The pawl 14 is biased to the engaged position (biasing springs not shown).

A "snowload" lever 30 is pivotably mounted to the support body 16 via pin 32. The snowload lever 30 pivots between a "disengaged" position shown in FIG. 1 to an "engaged" position shown in FIG. 5, which is discussed in greater detail below. A torsion spring 34 biases the snowload lever to the engaged position (note that the mounting of the spring 34 against the support body 16 is not shown).

An electromechanical release actuator 40 controls the release of the ratchet 12 and pawl 14. The actuator 40 includes a motor 42 connected to a pinion gear 44 and a reduction gear 46. The reduction gear 46 is integrally formed with a lead screw 48 that is journalled within the support body, such that the lead screw 48 rotates in situ. A nutscrew 50 is threadingly mated to the lead screw 48 and constrained from rotating by the support body (details not shown) such that rotation of the lead screw 48 causes the nutscrew 50 to translate along the length of the screw. A return spring 52 is coaxially mounted about the lead screw 48 to urge the nutscrew 50 back to its starting position (the starting position being shown in FIG. 1).

The nutscrew 50 has a projection 54 that functions as the output member of the actuator 40. The actuator output member 54 interacts with both the snowload lever 30 and pawl 14.

Figure 2:
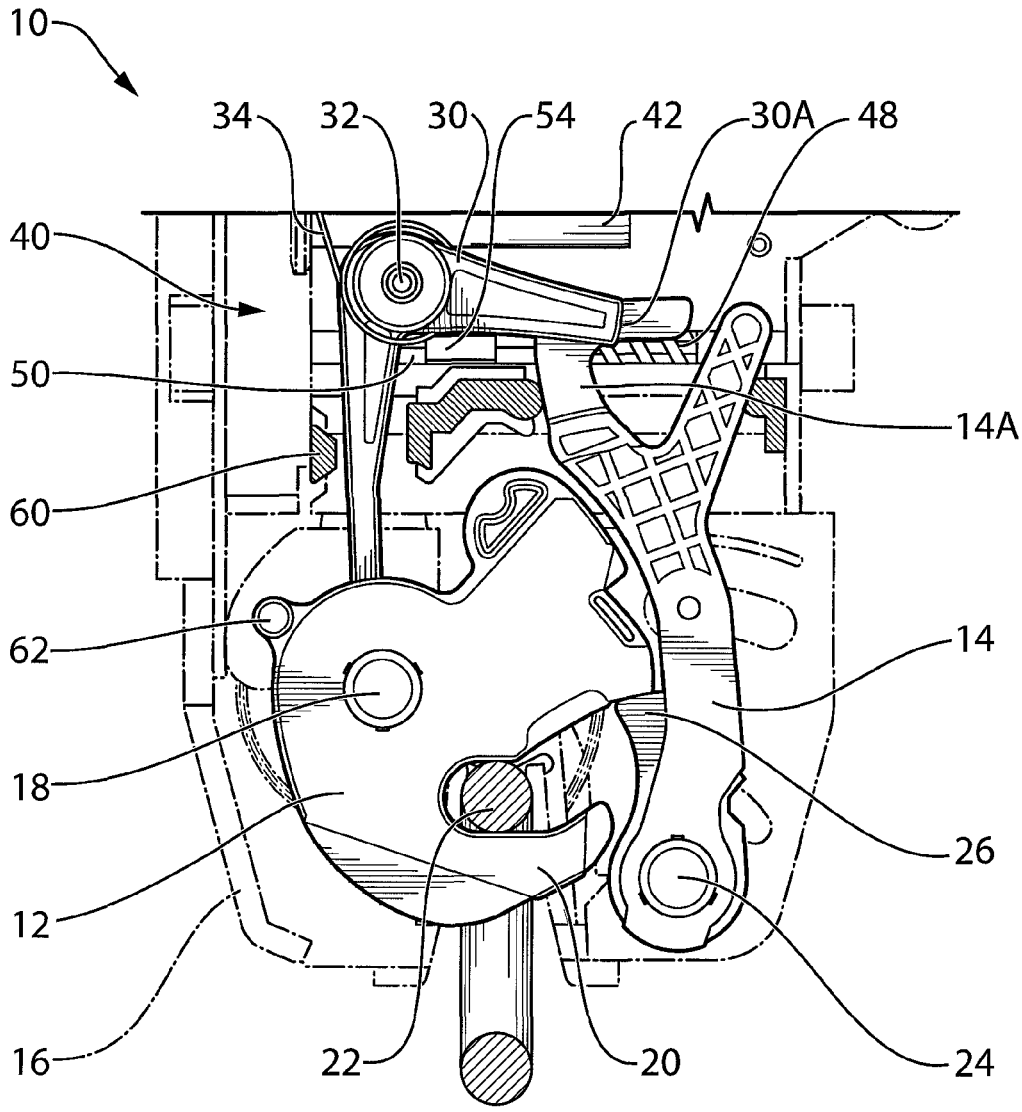
FIG. 2 is an enlarged plan view of the latch in the latched position.

More particularly, FIG. 2 also shows the ratchet 12 in the latched position. In this position, the pawl 14 engages the ratchet 12, and the actuator output member 54 checks the rotational motion of the snowload lever 30 (it is biased clockwise in the drawing). The actuator output member 54 also abuts against an arm 14A of the pawl 14.

Figure 3:
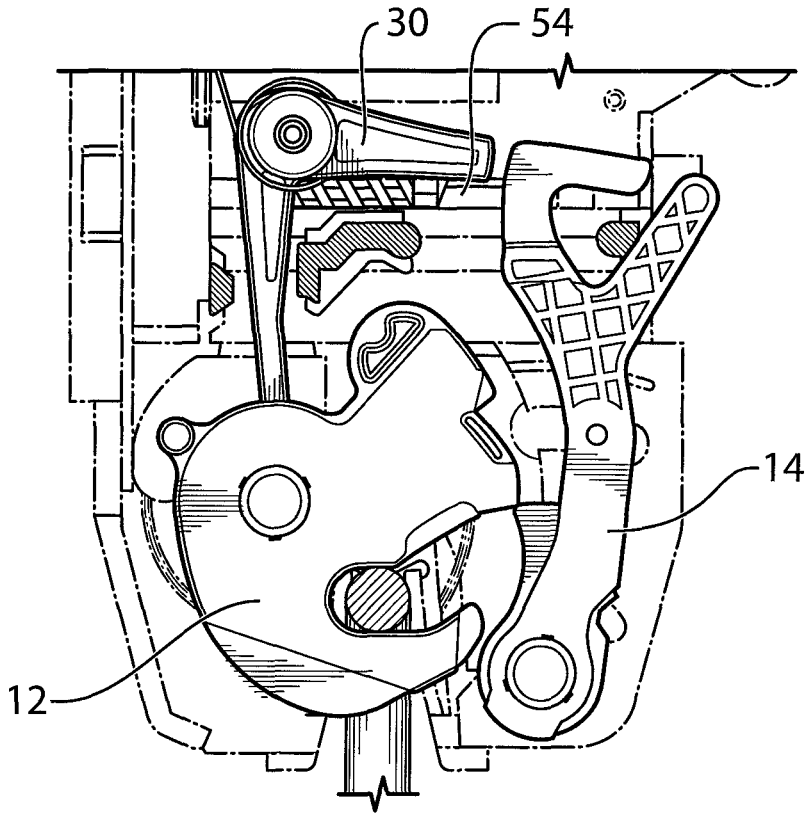
FIG. 3 is a plan view of the latch in a partial release position.
Figure 4:
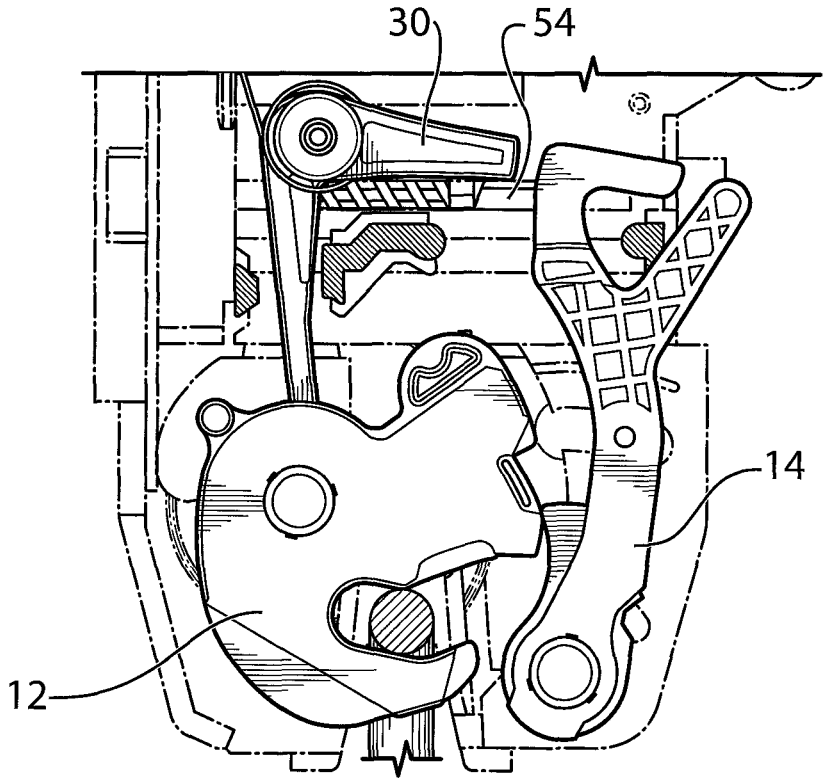
FIG. 4 is a plan view of the latch in a release position.

In order to release the latch, the actuator 40 is energized, whereby the actuator output member 54 pushes the pawl arm 14A in order to rotate the pawl 14 toward the disengaged position. FIGS. 3 and 4 shows the latch as the actuator output member 54 nears the end of its stroke, where the pawl 14 disengages from the ratchet 12, which begins its rotation towards the release position. The snowload lever 30 is still checked by the actuator output member 54.

In this position, the ratchet 12 may be prevented from fully moving to the released position due to an external load, e.g. caused by the weight of snow. For this reason, the pawl 14 is prevented from returning back to its engaged position by the snowload lever 30, as seen in FIG. 5.

Figure 5:
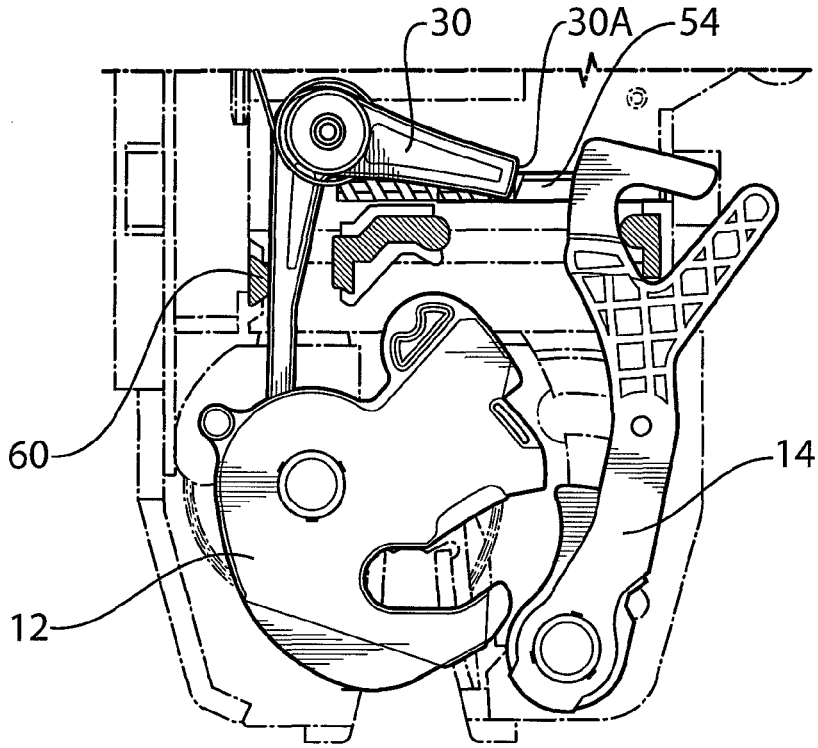
FIG. 5 is a plan view of the latch in a disengaged position.
Figure 6:
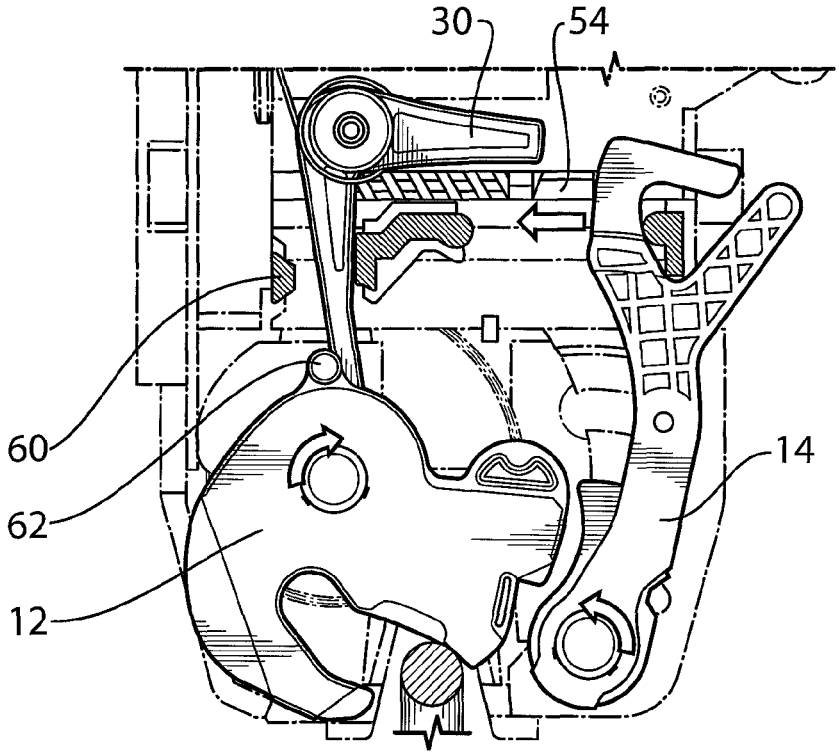
FIG. 6 is a plan view of the latch shown returning to a starting position.

Referring more particularly to FIG. 5, the actuator output member 54 continues to move linearly past edge 30A of the horizontal arm of the snowload lever 30. This enables the snowload lever 30 to rotate into its engaged position, wherein the vertical arm of the snowload lever is checked by bumper 60, and the horizontal arm of the snowload lever 30 blocks the actuator output member 54, keeping the nutscrew 50 at the end of its stroke and preventing it from returning, whereby the pawl 14 is maintained in its disengaged position. The latch will remain in this condition until the ratchet 12 rotates to its released position, shown in FIG. 6. In the process, as shown in FIG. 6, the ratchet 12, through a projection 62, will push against the vertical arm of the snowload lever 30, thus sweeping the horizontal arm of the snowload lever 30 out of the path of the actuator output member 54 and nutscrew 50. This enables the actuator output member/nutscrew to rapidly return (under action of return spring 52 not shown in FIG. 6)

to its starting position, shown in FIG. 1, and enables the pawl 14 to rotate into a position where it once again contacts or engages the ratchet 12.

The illustrated embodiment has been described with particularity for the purposes of description. Those skilled in the art will appreciate that a variety of modifications may be made to the embodiment described herein without departing from the spirit of the invention.

What is claimed is:

1. A latch, comprising:

a support body;

a ratchet rotatably coupled to the support body and rotatable between a latched position and a released position, the ratchet being biased to the released position;

a pawl pivotally coupled to the support body and pivotal between a ratchet-engaged position in which the pawl engages and checks the movement of the ratchet and a ratchet-disengaged position spaced from and disengaged from the ratchet, the pawl being biased to the ratchet-engaged position;

an electromechanical actuator having an actuator output member for moving the pawl to the ratchet-disengaged position, the actuator output member moving along a travel path between a start position and an end position and vice versa, wherein the actuator output member is constrained from rotating, and wherein the electromechanical actuator includes a motor and gear assembly, a lead screw operatively coupled to the motor and gear assembly for rotation thereby and extending longitudinally between a first end coupled to the motor and gear assembly and an opposite second end adjacent the pawl, a nutscrew threadably mounted on the lead screw and constrained from rotation so as to translate longitudinally along the lead screw between the first B and second ends in response to rotation thereof, and a projection extending from the nutscrew, defining the actuator output member; and a snowload lever pivotally coupled to the support body and pivotal between a pawl-disengaged position and a pawl-engaged position, the snowload lever including a horizontal arm and a vertical arm wherein the actuator output member is abutted between the horizontal arm and the pawl when the snowload lever is pivoted to the pawl-engaged position to maintain the pawl in the ratchet-disengaged position and the vertical arm is engaged by the ratchet in the released position to pivot the snowload lever to the pawl-disengaged position returning the pawl to the ratchet-engaged position.

2. A latch according to claim 1, wherein the snowload lever is biased to the pawl-engaged position, and wherein during a first portion of movement of the actuator output member along the travel path, the actuator output member engages the horizontal arm and maintains the snowload lever in the pawl-disengaged position while engaging and pivoting the pawl from the ratchet-engaged to ratchet-disengaged position.

3. A latch according to claim 2, wherein during a second portion of movement of the actuator output member along the travel path, the actuator output member moves past an edge of the snowload lever to the end position, thereby allowing the snowload lever to move in a first direction to the pawl-engaged position abutting the actuator output member between the pawl and the edge of the snowload lever and maintaining the pawl in the ratchet-disengaged position.

4. A latch according to claim 3, wherein the ratchet includes a projection for engaging the vertical arm of the snowload lever and moving the snowload lever out of the pawl-engaged position as the ratchet moves to the released position.

5. A latch according to claim 3, wherein the actuator output member returns from the end position to the start position in response to movement of the snowload lever from the pawl-engaged position to the pawl-disengaged position.

6. A latch according to claim 5, wherein the ratchet moves the snowload lever in a second direction, opposite the first direction, out of the pawl-engaged position to the pawl-disengaged position.

7. A latch, comprising:

a ratchet moveable between a latched position and a released position, the ratchet being biased to the released position;

a pawl moveable between a ratchet-engaged position in which the pawl engages and checks the movement of the ratchet and a ratchet-disengaged position spaced and disengaged from the ratchet, the pawl being biased to the ratchet-engaged position;

an electromechanical actuator including a motor and gear assembly, a lead screw operatively coupled to the motor and gear assembly for rotation thereby and extending longitudinally between a first end coupled to the motor and gear assembly and an opposite second end adjacent the pawl, a nutscrew mounted on the lead screw and constrained from rotation so as to translate longitudinally along the lead screw between the first and second ends thereof upon rotation of the lead screw, and a projection extending from the nutscrew defining an actuator output member for moving along a travel path between a start position and an end position; and a snowload lever moveable between a pawl-disengaged position and a pawl-engaged position, wherein, in the pawl-engaged position, the snowload lever blocks the actuator output member from returning to the start position, and wherein during a first portion of movement of the actuator output member along the travel path, the actuator output member maintains the snowload lever in the pawl-disengaged position, and wherein during a second portion of movement of the actuator output member along the travel path, the actuator output member moves past an edge of the snowload lever to the end position, thereby allowing the snowload lever to move in a first direction to the pawl-engaged position;

wherein the ratchet moves the snowload lever in a second direction, opposite the first direction, out of the pawl-engaged position to the pawl-disengaged position.

8. A latch according to claim 7, wherein the snowload lever is biased to the pawl-engaged position.

9. A latch according to claim 8, wherein the ratchet includes a projection for moving the snowload lever out of the pawl-engaged position as the ratchet moves to the released position.

10. A latch according to claim 9, wherein the actuator output member is constrained from rotating.

11. A latch according to claim 10, wherein the actuator output member returns from the end position to the start position in response to movement of the snowload lever from the pawl-engaged position to the pawl-disengaged position.

* * * * *